US009852856B2

(12) United States Patent
Bowen

(10) Patent No.: US 9,852,856 B2
(45) Date of Patent: Dec. 26, 2017

(54) HIGH TEMPERATURE CONTROL KNOB

(71) Applicant: Archie Brooks Bowen, Belden, MS (US)

(72) Inventor: Archie Brooks Bowen, Belden, MS (US)

( * ) Notice: Subject to any disclaimer, the term of this patent is extended or adjusted under 35 U.S.C. 154(b) by 0 days.

(21) Appl. No.: 15/000,880

(22) Filed: Jan. 19, 2016

(65) Prior Publication Data

US 2016/0329175 A1 Nov. 10, 2016

Related U.S. Application Data

(60) Provisional application No. 62/157,340, filed on May 5, 2015.

(51) Int. Cl.

| | |
|---|---|
| ***H01H 19/14*** | (2006.01) |
| ***H01H 19/11*** | (2006.01) |
| ***F24C 7/08*** | (2006.01) |

(52) U.S. Cl.

CPC ..... *H01H 19/14* (2013.01); *F24C 7/082* (2013.01); *H01H 19/11* (2013.01); *H01H 2231/012* (2013.01); *H01H 2231/052* (2013.01)

(58) Field of Classification Search

CPC .. H01H 19/03; H01H 19/14; H01H 2231/052; H01H 2231/012; H01H 19/11; H01H 19/115; F24C 7/082

See application file for complete search history.

(56) References Cited

U.S. PATENT DOCUMENTS

| | | | | |
|---|---|---|---|---|
| 784,305 | A | 3/1905 | Oornforth | |
| 3,067,629 | A * | 12/1962 | Zurles | H01H 3/04 74/526 |
| 4,079,347 | A * | 3/1978 | Poling | H01H 37/12 337/304 |
| 6,079,401 | A | 6/2000 | Alvord | |
| 6,239,414 | B1 | 5/2001 | Newcomer | |
| 7,816,818 | B2 | 10/2010 | Sellecchia | |
| 2012/0204854 | A1 | 8/2012 | Dondurur | |

OTHER PUBLICATIONS https://www.google.com/search?q=oven+adjustable+know,pp. 1-7, Oct. 16, 2015 3:57 PM.

* cited by examiner

*Primary Examiner* — Felix O Figueroa
(74) *Attorney, Agent, or Firm* — William C. West

(57) ABSTRACT

The invention is a high temperature control knob that is installed on the power control knob stem of an existing appliance to prevent a material being heated from reaching a predetermined maximum temperature (e.g., the burning point temperature for oil), and thereby preventing an undesired event (e.g., a fire). The high temperature control knob comprises an alignment means having at least one stop that is adjustable about a set of temperature markings containing the predetermined maximum temperature, and may further comprise a dial with an arm that mounts of the power control knob stem. The at least one stop may be aligned to the predetermined maximum temperature by rotating the alignment means about the power control knob stem and tightening a fixing means to hold the alignment means in place. The arm of the dial contacts the at least one stop preventing the appliance from exceeding the predetermined maximum temperature.

17 Claims, 9 Drawing Sheets

HIGH TEMPERATURE CONTROL KNOB

CROSS-REFERENCE TO RELATED APPLICATIONS

This application for an invention claims the benefit of U.S. Provisional Application No. 62/157,340, High Temperature Control Knob, filed May 5, 2015.

BACKGROUND OF THE INVENTION

Technical Field of the Invention

The invention relates to temperature control devices. More particularly the invention relates to temperature control devices for retrofitting appliances in order to prevent the temperature from exceeding a predetermined maximum temperature.

Even more particularly, the invention pertains to a high temperature control knob which may be utilized on an existing appliance, such as a stove or oven, without the addition of additional electronic wiring to the appliance.

Prior Art

The prior art includes devices for regulating temperature using sensors which are found on thermostat type devices. The prior art of record shows a number of devices for controlling the temperature of the surface of an oven.

A problem with existing technology is that it is not easily adaptable to the numerous models of appliances in the market place to control the temperature of a substance, such as oil in a container. The invention discloses a high temperature control knob that may be used on any existing appliance.

GENERAL DISCUSSION OF THE INVENTION

The invention addresses the need to have a high temperature control knob which an user could add to an existing appliance, such as an oven or surface heating element of a stove. The invention would prevent a substance from reaching undesired temperatures resulting in disastrous consequences, such as oil reaching its burning point and causing a fire.

In a simple embodiment of the device described herein, the invention provides an alignment means with at least one stop. The alignment means may be adjusted using an adjusting means to align the at least one stop with a preselected maximum temperature to prevent an arm on a dial from going past at least the one stop, thereby preventing the appliance from exceeding the preselected maximum temperature. The invention can be applied to an existing appliance, such as a stove, over an existing control knob stem. Where the existing appliance dials do not have the arm, a dial with the arm may be applied to the control knob stem to which the replaced existing appliance dials were attached. The alignment means may be mounted around the power control knob stem and may be secured to the face of the appliance using existing screws in threaded apertures that are located around a control knob stem so that at least the one stop of the alignment means can be rotated along an arc aligned with a set of temperatures or the alignment means may be otherwise mounted to the existing appliance using a fixing means, such as screws. The arm contacts at least the one stop when the arm reaches a predetermined power level associated with a preselected maximum temperature for which at least the one stop is aligned to prevent the appliance from going over desirable heat levels.

One place where this type of technology would be particularly beneficial would be in the rental house market. In these situations an owner of a rental unit may want to provide for additional care in order to protect tenants and may wish to retrofit the appliances so that the appliances will operate in safer temperature ranges, particularly for frying oil.

The problem with prior art devices is they require a great deal of expense because they are not easily retrofitted onto existing equipment.

It is the main purpose of the invention as described above to provide a high temperature control knob which is attached to an existing appliance control knob stem and which serves to prevent the temperature of an item on top of a burner or within an appliance from being heated above a predetermined maximum temperature.

It is a further object of the invention to provide a high temperature control knob for preventing oil on top of a appliance from being heated above the flash point at which it ignites.

These and other objects and advantages of the invention will become better understood hereinafter from a consideration of the specification with reference to the accompanying drawings forming part thereof, and in which numerals correspond to parts throughout the several views of the invention with like parts be identified by the same numeral.

One other benefit of the high temperature control knob for the appliance is that it lowers the power consumption while cooking. The percent conception loss is believed to be between 30% & 50% based on laboratory tests.

Also, one related benefit is that the oil used can be consumed over a longer period of time because the oil is not as badly damaged by high temperature.

Yet another related benefit is that the oil does not smoke as badly if left for extended period of times as it would without the devise. Less smoke and oil residue are present with the devise than in the situation without it.

In addition, it is believed that there is not a significant difference in the time required for heating the oil to the temperature of 375°, the approximate desired temperature so that there is both an energy savings, safety savings and a environmental (reduction of smoke and type of smoke) benefit to the devise.

The oil smoke point is the temperature at which the oil begins to decompose and visible smoke is given off. Typically, once the smoke point is reached, the oil begins to degrade. This is the reason why maintaining the frying temperature of approximately 195° centigrade or 375° Fahrenheit is important. This allows a batter coated surface to quickly form a protective shield from penetrating the cold food and making it greasy.

DESCRIPTION OF DRAWINGS

For a further understanding of the nature and objects of the invention, reference should be made to the following detailed description taken in conjunction with the accompanying drawings in which like parts are given like reference numerals and wherein.

DETAILED DESCRIPTION OF THE INVENTION

Figure 1:
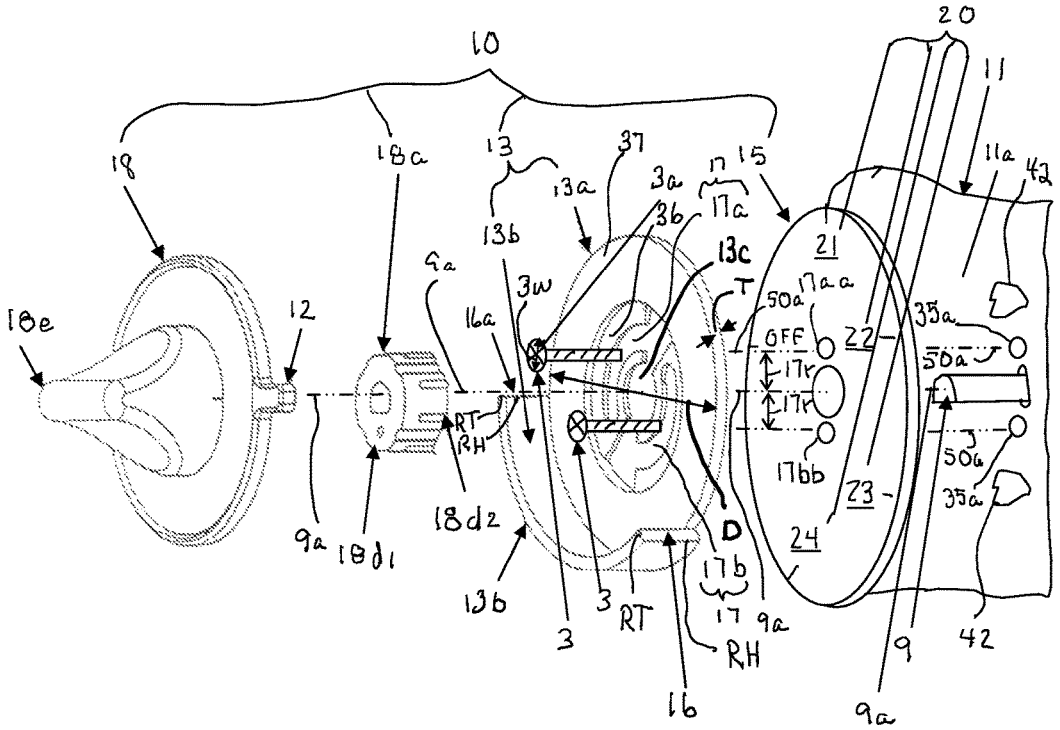
FIG. 1 shows show a prospective view of a dial, an adapter, an alignment means, and a rear plate of one embodiment of the invention aligned with a control knob stem of an appliance that does not have a set of temperature markings that are observable.
Figure 2:
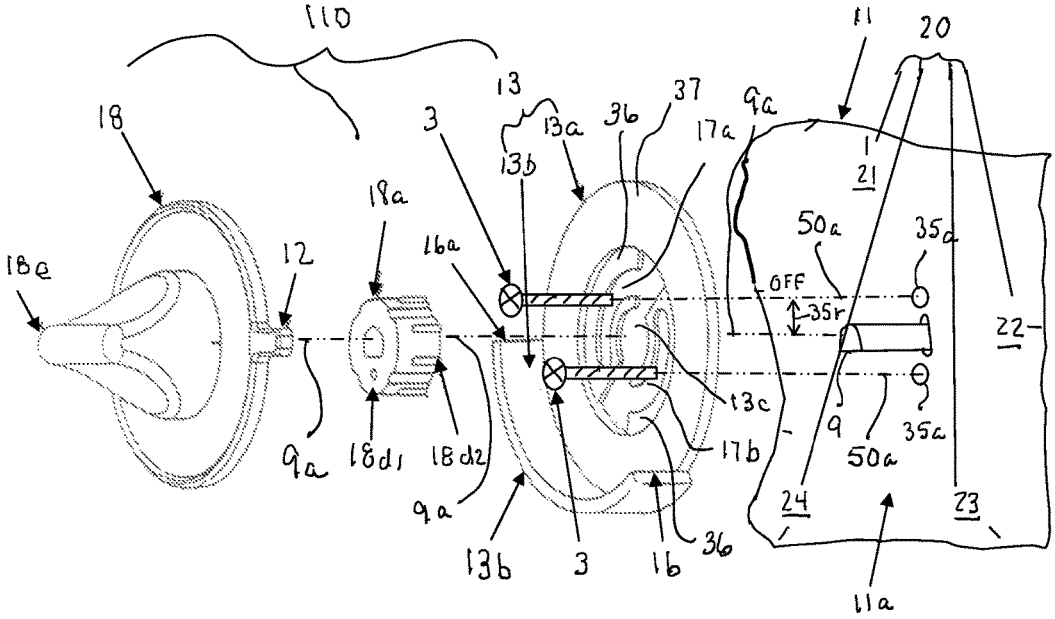
FIG. 2 show a prospective view of the dial, the adapter, and the alignment means of FIG. 1 aligned with the control knob stem on an appliance having the set of temperature markings on the face of the appliance.

The invention is a high temperature control knob 10 for retrofitting an appliance 11, such as a stove, having at least one control knob stem 9 as shown in FIG. 1. The control knob stem 9 extends from a face 11*a* of the appliance 11 and the control knob stem 9 is movable (i.e., can be turned or rotated) about a longitudinal axis 9*a* of the control knob stem 9. As can best be seen by reference to FIG. 1 in one embodiment, the high temperature control knob 10 comprises: an alignment means 13 having a disc portion 13*a* and a raised portion 13*b*; a rear plate 15; a dial 18; and an adapter 18*a*. The disc portion 13*a* disposed generally perpendicular to the raised portion 13*b*. The rear plate 15 comprises a set of temperature markings 20 that may include a first temperature 21, a second temperature 22, a third temperature 23, and a fourth temperature 24, and may be used when the set of temperature markings 20 are not observable on the appliance 11 or will be covered after installing the alignment means 13. Looking to FIG. 2, where the set of temperature markings 20 is observable on the appliance 11, the rear plate 15 is not required. Looking to FIGS. 3 and 4, the dial 18 has an arm 12 and a rear face 18*b*. The rear face 18*b* has a depression 18*c* sized for the adapter 18*a* shown in FIG. 3. Referring again to FIG. 1, the disc portion 13*a* may comprise an adjusting means 17, such as at least a first slot 17*a*, or at least a second slot 17*b*. Although the first slot 17*a* as shown is elongated and curved, the first slot 17*a* could be a circular through aperture similar to a first rear slot 17*aa* of the rear plate 15. The alignment means 13 further may comprise a center slot 13*c*, generally centered in the disc portion 13*a*. The alignment means 13 fits around the control knob stem 9 of the appliance 11 by placing (i.e., inserting) the control knob stem 9 through center slot 13*c*. The disc portion 13*a* may have a diameter D between 1.5 and 3 inches, and a thickness T between 0.1 to 0.3 inches. The raised portion 13*b* may be attached circumferentially to the disc portion 13*a* as shown in FIG. 1 or may be mounted on (not shown) an outer face 37 of the disc portion 13*a* and may have a raised height RH between 0.25 to 1.00 inches, as measured perpendicular the disc portion 13*a* and may have a raised thickness RT between 0.1 and 0.2 inches. The raised portion 13*b* may have at least one stop 16 on one end and may also have an alternate stop 16*a* on an other end configured to contact the arm 12 on the dial 18 when the dial 18 is rotated clockwise and counter-clockwise, respectively. The raised portion 13*b* extends perpendicular to the outer face 37 of the disc portion 13*a* away the face 11*a* of the appliance 11.

Figure 4:
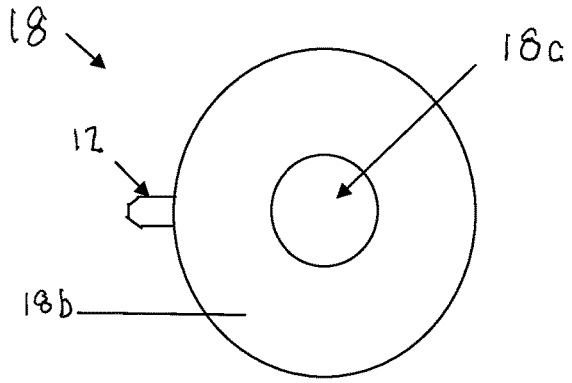
FIG. 4 shows a rear face view of the dial with a depression for the adapter of the one embodiment of the invention.
Figure 5:
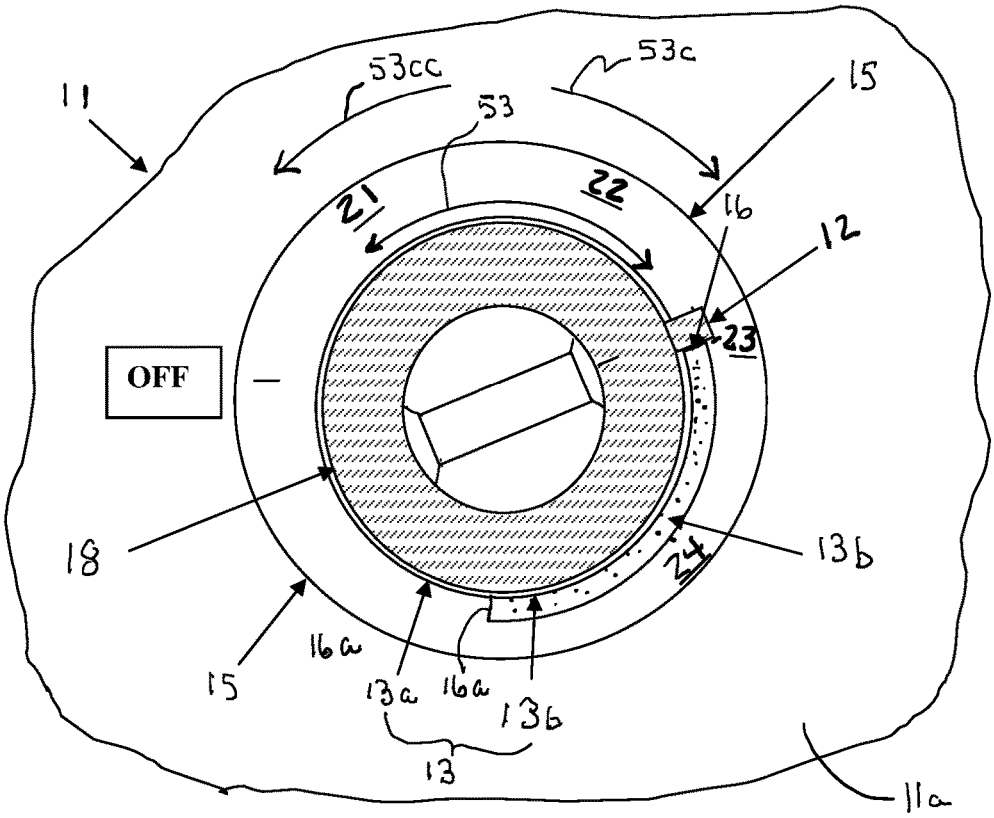
FIG. 5 shows a frontal view of the one embodiment of the invention with the at least one stop at a third temperature marking.

The adapter 18*a* may be similar to a type commonly known in the art as an adapter insert, such as the adapter insert with Electric Range Knobs under parts number PM3X84 and with Gas Ranges Knobs under parts number 3M3X88 by General Electric. Looking to FIG. 3, a first end 18*d*1 of the adapter 18*a* is inserted in a depression 18*c* (shown in FIG. 4) in the rear face 18*b* of the dial 18, and a second end 18*d*2 of the adapter 18*a* is attached to the control knob stem 9. Looking to FIG. 3, the depression 18*c* is sized to hold the adapter 18*a*. The adapter 18*a* may have an adapter diameter AD between ½ to ¾ inches, but generally ⅝ inches, and may have an adapter height AH between ¼ to ¾ inches high, but generally ⅜ inches, with generally ⅛ inches of the adapter extending out of the rear face 18*b* of the dial 18. The dial 18 is turned using the hand ridge 18*e*. The dial 18 may be generally of a configuration and composition similar to the range knobs is the art, such as the electric range knobs sold with the adapter inserts by General Electric under parts number PM3X84, except the dial 18 of the one embodiment of the invention has the arm 12. The arm 12 is configured to contact the at least one stop 16 when the dial 18 is mounted on the control knob stem 9. The arm 12 may have arm length AL sufficient to extend beyond the at least one stop 16 as shown in FIG. 5, and an arm width AW that may be between 0.18 to 0.25 inches, but could be greater. There are usually four or five such control knob stems 9 on the appliance 11 but for purposes of understanding the invention, it is only necessary to focus on one such control knob stem 9.

Figure 6:
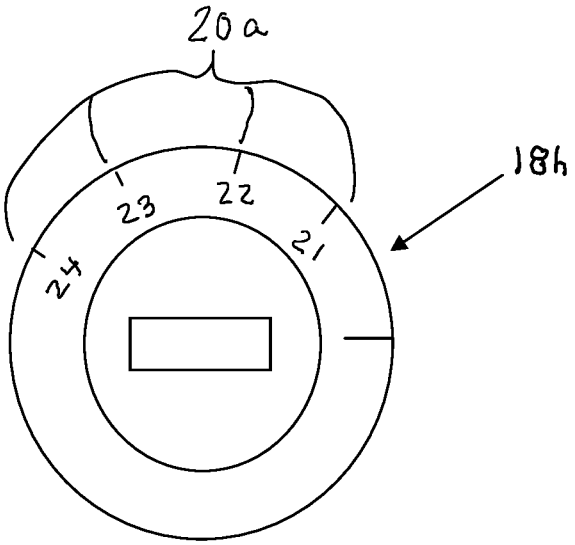
FIG. 6 shows a frontal view of an original appliance knob having a set of original temperature markings.

Looking to FIG. 6, where a set of original temperature markings 20 is located on an original knob 18*h*, the rear plate 15 may be used. The set of original temperature markings 20*a* will be compatible with the set of temperature marking 20 shown in FIGS. 1 and 2. Referring to FIG. 1, the alignment means 13 is between the adapter 18*a* and the rear plate 15 when the rear plate 15 mounted to the face 11*a* of the appliance 11 along a longitudinal axis 9*a* of the control knob stem 9 in the one embodiment. Looking to FIG. 5, at least the one stop 16 may be adjustable about the arc 53. Increasing temperatures may be achieved by turning (i.e., rotating) the dial 18 and the arm 12 in a clockwise direction 53*c*, the alignment means 13 may be turned along an arc 53 in a counter clockwise direction 53*cc* relative to the rear plate 15 and the face 11*a* of the appliance 11 to align the at least one stop 16 to the predetermined maximum temperature, such as third temperature 23. Alternatively, where the increasing temperatures are achieved by turning (i.e., rotating) the dial 18 and the arm 12 in a counterclockwise direction 53*cc*, the alignment means may be turned in a clockwise direction 53*c* to align the alternate stop 16*a*. Looking again to FIG. 1, the rear plate 15 may be affixed to the face 11*a* of the appliance 11 by doubled sided tape (not shown), a rear plate screw (not shown), or an adhesive 42, such as glue.

Continuing to look at FIG. 1, by having the adjusting means 17, such as at least the first slot 17*a* in the alignment means 13, the position of the alignment means 13 may be held relative to the face 11*a* of the appliance 11 by a fixing means, such as a first screw 3, passing along a first threaded axis 50*a* through the first slot 17*a* of the alignment means 13 and the first rear slot 17*aa* of the rear plate 15, and into a threaded aperture, such as a threaded aperture 35*a*, which is within the face 11*a* of the appliance 11. A second fixing means, such as a second screw 3, may be inserted along a second threaded axis 50*a* through the second slot 17*b* of the alignment means and a second rear slot 17*bb* of the rear plate 15 and into a second threaded aperture 35*a*, to more securely hold the alignment means 13 in position. The first slot 17*a* and the second slot 17*b* are equivalent and may positioned to fit over the first and second threaded apertures 35*a* that may be found on the face 11*a* of the appliance 11. The position of the alignment means 13 to the rear plate 15 and the face 11*a* of the appliance 11 is fixed by tightening at least the first screw 3 into the first threaded aperture 35*a* on the face 11*a* of the appliance 11 so that a head underside 3*a* of the first screw 3 presses against an inner face 36 around the first slot 17*a* of the disc portion 13*a*. In a like manner the second screw 3 may be tightened around the second slot 17*b*. The inner face 36 may be somewhat recessed with respect to the outer face 37 of the disc portion 13*a* to allow the first screw 3 to not rise above the outer face 37 once the first screw 3 is tightened in the first threaded aperture 35*a*. The disk portion 13*a* is generally disposed perpendicular to the longitudinal axis 9*a* of the control knob stem 9.

Looking to FIG. 5, the set of temperature markings 20 assist in fixing the position of the at least the first stop 16 relative to the rear plate 15 at various locations on the rear plate 15 so that the temperature may be controlled in accordance with the one embodiment described herein.

Looking again to FIG. 1, the dial 18 is functionally connected to the control knob stem 9 so that the turning of the dial 18 turns the control knob stem 9. The control knob stem 9 is part of the existing appliance and is in contact with and functionally connects to the power of the appliance 11 so that as the dial 18 is turned the control knob stem 9 is turned thereby controlling the maximum temperature of the appliance 11.

Looking again to FIG. 5, the arm 12 will move around an arc 53 as the dial 18 turns the gas or power on in response to pressure from an user's hand. As the dial 18 is turned, at least one stop 16 arrest an arm 12 of a dial by at least the arm 12 contacting at least the one stop 16. At least the one stop 16 may be fixed in one location or it may be adjustable to several locations, such as the first temperature 21, the second temperature 22, the third temperature 23 and the fourth temperature 24. When placed on the rear plate 15, the set of temperature markings 20 will be compatible with the set of temperature markings 20 shown in FIG. 2 on the face 11*a* of the appliance or the set of original temperature markings 20*a* an the original knob 18*h* as shown in FIG. 6.

Looking again to FIG. 5, the dial 18 may be turned until the arm 12 contacts the at least one stop 16. The at least one stop 16 in this embodiment is at the third temperature 23. As an example, assuming the first maximum temperature corresponds to the third temperature 23 is between 300 and 410 degrees in order to prevent hot oil or grease from burning and in order to keep the temperature below the temperature at which hot oil or grease would burn, then the first maximum temperature corresponding to the third temperature 23 also corresponds to an approximate predetermined maximum temperature considered appropriate for the control knob stem 9, meaning the high temperature control knob 10 should prevent the appliance 11 from exceeding the third temperature 23 when at least the one stop 16 is the set at the third temperature 23.

Figure 7:
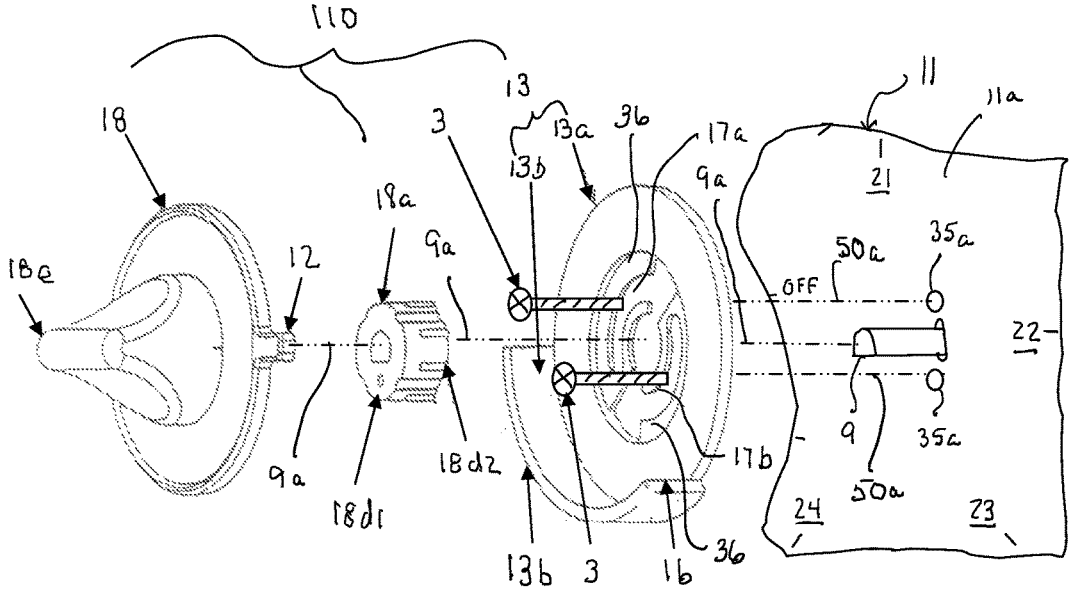
FIG. 7 shows a prospective view of another embodiment of the invention comprising the dial, the adapter, and the alignment means of the one embodiment of the invention aligned with the control knob stem on the appliance with the set of temperature marking on the face of the appliance.

In another embodiment of the invention, a plate-less high temperature control knob 110 is shown in FIG. 7. The set of temperature markings, such as the first temperature 21, the second temperature 22, the third temperature 23, and the fourth temperature 24, are observable on the face 11*a* of the appliance 11. The plate-less high temperature control knob 110 has all the elements of the high temperature control shown in FIG. 1 but the deletes the rear plate 15.

Figure 8:
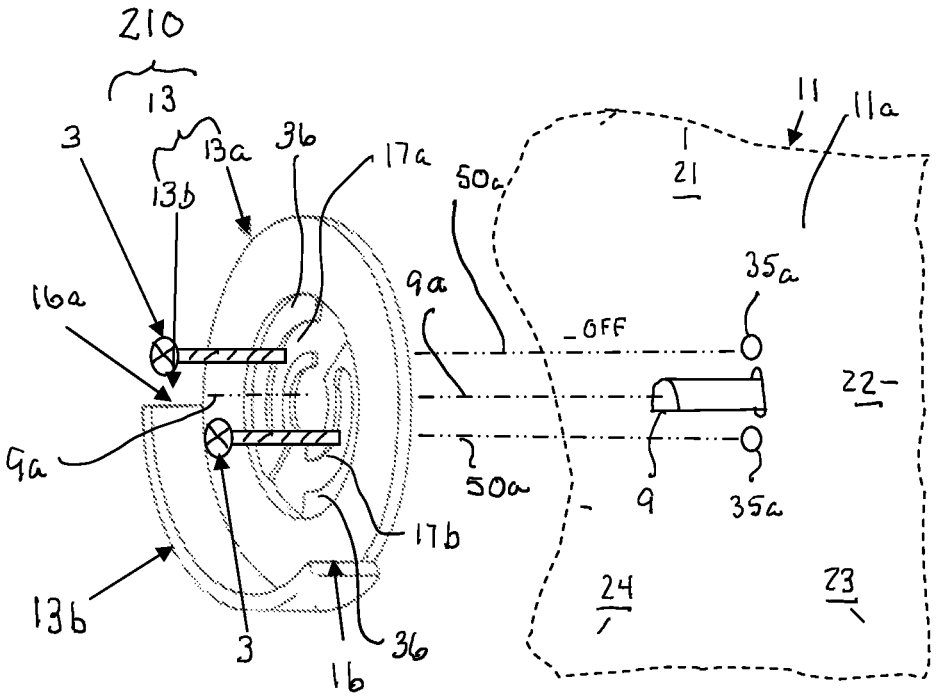
FIG. 8 shows a prospective view of yet another embodiment of the invention comprising only the alignment means of the of the one embodiment of the invention.

Looking to FIG. 8, in yet another embodiment of the invention, an alignment high temperature control knob 210 comprises only the alignment means 13 of the high temperature control knob shown in FIG. 1. The dial 18 with the arm 12 are originally a part of the appliance, and the set of temperature markings such as the first temperature 21, the second temperature 22, the third temperature 23, and the fourth temperature 24, are observable on the appliance 11 deleting the requirement for the rear plate 15. Thus, the alignment high temperature control knob 210 would comprise only the alignment means 13 of the high temperature control knob shown in FIG. 1.

Figure 9:
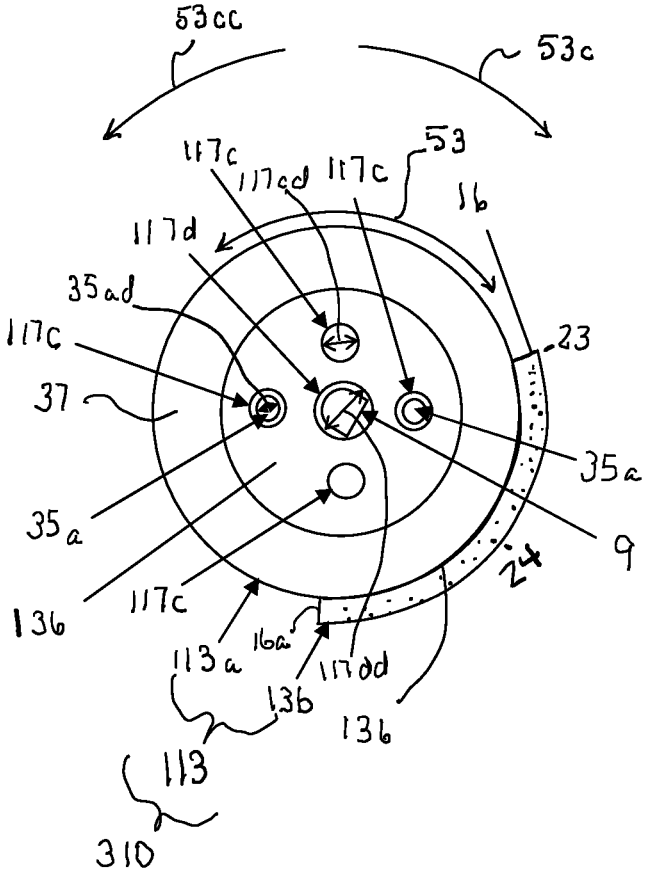
FIG. 9 shows a frontal view of an alternate alignment means with a plurality of hold apertures.
Figure 10:
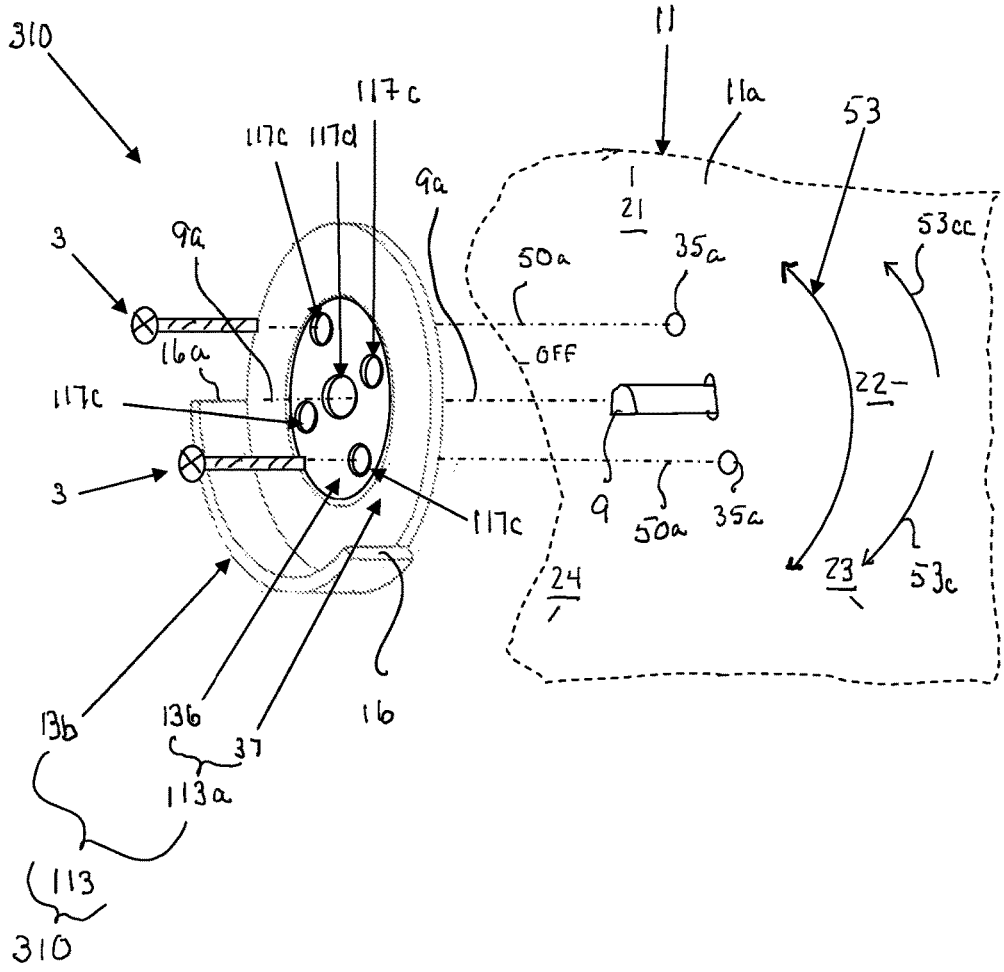
FIG. 10 shows a prospective view of an alternate alignment means with a plurality of hold apertures.

Referring to FIGS. 9 and 10, a modified alignment high temperature control knob 310 may consist of an alternate alignment means 113. The alignment means 13 shown in FIGS. 1, 2, 3, 7, and 8 may be replaced by an alternate alignment means 113. The first slot 17*a* and the second slot 17*b* of the alignment means 13 shown in FIG. 1 may be replaced by a plurality of hold slots, such as a hold aperture 117*c*, as show in FIGS. 9 and 10, and the center slot 13*c* shown in FIG. 1 may be replaced by a stem aperture 117*d* shown in FIGS. 9 and 10. Referring to FIG. 9, the hold aperture 117*c* has a hold aperture diameter 117*cd* somewhat larger than the threaded aperture diameter 35*ad*. The alternate alignment means 113 comprises an alternate disc portion 113*a* and the raised portion 13*b* of FIG. 1. The alternate disc portion 113*a* comprises: an alternate inner face 136 with the plurality of hold slots, such as the hold aperture 117*c*; the same outer face 37 as shown in FIG. 1; and the stem aperture 117*d*. The plurality of hold slots is disposed circularly centered on the stem aperture 117*d*. The stem aperture 117*d* has a stem aperture diameter 117*dd* somewhat larger than the control knob stem 9, allowing the control knob stem 9 to be disposed through (i.e., inserted) the stem aperture 117*d* of the modified alternate alignment means 113. The alternate inner face 136 is recessed in the alternate disc portion 113*a* to allow the first screw 3 to remain below the outer face 37 when the first screw 3 is tightened in the first threaded aperture 35*a*. The plurality of hold slots, such as hold aperture 117*c* may replace the first slot 17*a* and the second slot 17*b* of the alignment means 13 shown in FIGS. 1, 2, 3, 7, and 8. The alternate alignment means 113 may be rotated about the control knob stem 9 along the arc 53 until the one stop 16 or the alternate stop 16*a* is at the desired location, the predetermined maximum temperature, such as any one of the first temperature 21, the second temperature 22, the third temperature 23 and the fourth temperature 24. The alternate alignment means 113 is then fixed by inserting the fixing means, such as the first screw 3 of FIG. 1, through least one of the plurality of hold slots, such as the hold aperture 117*c*, and into the first threaded aperture 35*a*.

Figure 3:
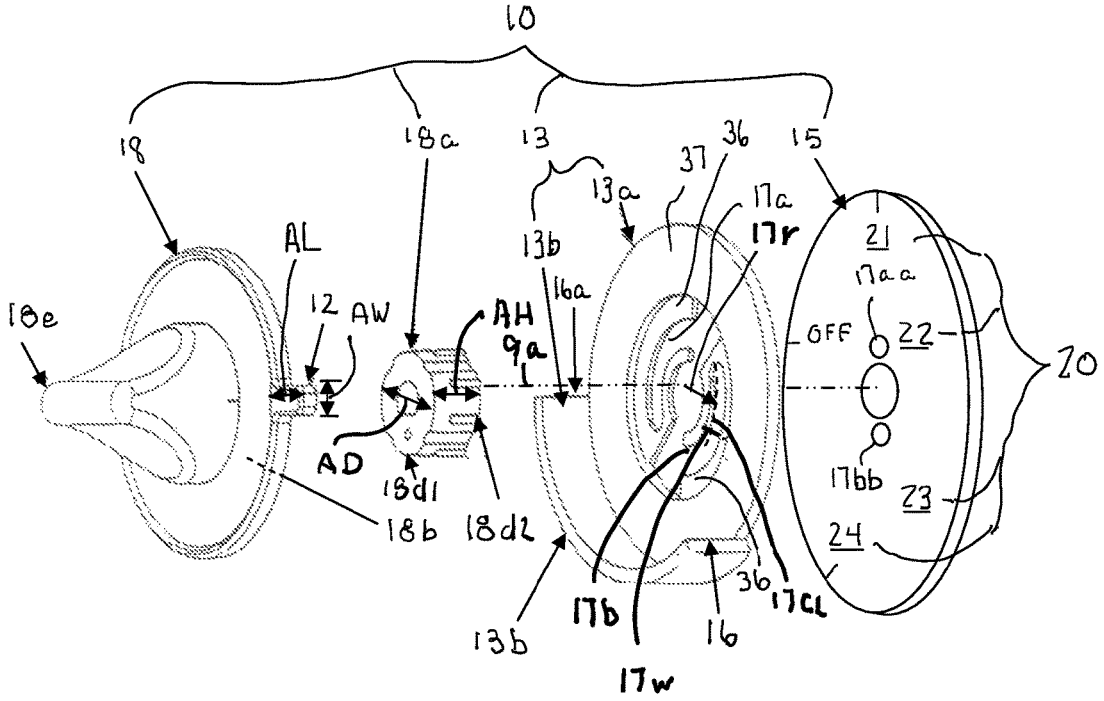
FIG. 3 shows a prospective view of the dial, the adapter, the alignment means, and the rear plate of the one embodiment of the invention.

Looking to FIG. 3 and specifically to the second slot 17*b*, the adjusting means 17, such as the second slot 17*b*, will have an adjusting means radius of curvature 17*r* equal to a distance from the longitudinal axis 9*a* to the adjusting means centerline 17*c*L, depicted by a dashed line. The adjusting means centerline 17*c*L is everywhere the adjusting means radius of curvature 17*r* (shown in FIG. 1) from the longitudinal axis 9*a*. The adjusting means radius of curvature 17*r* is equal to a threaded aperture radius of curvature 35*r* shown in FIG. 2. The threaded aperture radius of curvature 35*r* is the distance from the longitudinal axis 9*a* to the first threaded axis 50*a*. Looking to FIG. 3, the adjusting means 17, such second slot 17*b*, will have a adjusting means diameter 17*w* somewhat larger than the threaded aperture diameter 35*ad* (shown in FIG. 9) and the adjusting means diameter 17*w* will be centered along the adjusting means centerline 17*c*L The fixing means head diameter 3*w* shown in FIG. 1 will be somewhat larger that the adjusting means diameter 17*w* shown in FIG. 3, allowing the head underside 3*a* in FIG. 1 to be press against the inner face 36. The adjusting means 17, such as at least the first slot 17*a*, or the equivalent second slot 17*b*, may be viewed as the plurality of hold slots 117, such as the hold apertures 117*c* shown in FIG. 10, positioned along the adjusting means centerline 17*c*L shown in FIG. 3, and merged into each other forming a single slot, such as the second slot 17*b*.

In terms of a process the steps may be described as:

1) Selecting a predetermined maximum temperature, such as the third temperature 23 and removing the dial 18 from the control knob stem 9;
2) Loosening the fixing means, such as the first screw 3, on the alignment means 13 and rotating the alignment means 13 so that the at least one stop 16 is aligned with the predetermined maximum temperature;
3) Tightening the fixing means to fix the at least one stop 16;
4) Placing the dial 18 back on the control knob stem 9; and
5) Turning the dial 18 to a desired temperature that does not exceed the predetermined maximum temperature aligned with the one stop 16.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A high temperature control knob comprising an alignment means and a rear plate; the alignment means further comprising a disc portion and a raised portion; the alignment means having at least one stop; the alignment means disposed around a control knob stem; the control knob stem extending from a face of an appliance; the at least one stop being adjustable about an arc; the at least one stop arresting an arm of a dial when the dial is mounted on said control knob stem and turned along the arc contacting the at least one stop; and the alignment means located between the dial and the face of the appliance; the rear plate disposed placed around said control knob stem and affixed to the appliance; and the rear plate having a set of temperature markings disposed placed on the rear plate and to be observable when the alignment means is on the control knob stem; the rear plate disposed between the alignment means and the face of the appliance; and the face of the appliance having original temperature markings.

2. The high temperature control knob of claim 1, wherein the raised portion is disposed circumferentially on the disc portion; the raised portion having the at least one stop; the raised portion disposed generally perpendicular to a longitudinal axis of the control knob stem; the disc portion having an adjusting means; the adjusting means being a first slot and a second slot; the first slot and the second slot configured to align with a threaded aperture and a second threaded aperture, respectively, of the appliance; the adjusting means disposed on an inner face of said disc portion; and the adjusting means allowing said disc portion to be rotated about the longitudinal axis of said control knob stem and fixed using a fixing means once the at least one stop is aligned with a predetermined maximum temperature.

3. The high temperature control knob of claim 2 wherein the fixing means is at least a first screw and a second screw of the appliance; the first screw configured to fit in a threaded aperture and the second screw configured to fit a second threaded aperture on the face of the appliance; the alignment means disposed about the control knob stem; the first screw passing through the first slot in the alignment means and further passing into the threaded aperture and the second screw passing through the second slot in the alignment means and further passing into the second threaded aperture; the fixing means fixing the alignment means relative to the face of the appliance.

4. The high temperature control knob of claim 3, wherein said alignment means is fixed relative to the face of the appliance by tightening the first screw into the threaded aperture and the second screw in the second threaded aperture on the face of the appliance; a head underside on each of the first screw and the second screw against the inner face of the disc portion around the first slot and the second slot.

5. The high temperature control knob of claim 2, wherein at least a first slot on the inner face of the disc portion is disposed placed to allow for said disc portion to be turned along said control knob stem and fixed by tightening at least a first screw into a threaded aperture on the face of the appliance; a head underside of the first screw pressing against the inner face of the disc portion of the alignment means around the first slot.

6. The high temperature control knob of claim 1 wherein an adapter is sized to be placed in a depression of said dial, the adapter mounted on the control knob stem; and the adapter connecting the dial to the control knob stem.

7. The high temperature control knob of claim 1 further comprising the dial; the dial mounted using on the control knob stem using an adapter; a first end of the adapter inserted in a depression in the dial; and the control knob stem inserted in a second end of the adapter.

8. The high temperature control knob of claim 1 further comprising a fixing means; the fixing means being at least a first screw; at least the first screw passing through at least a first slot in the alignment means and further passing into at least a first threaded aperture located around the control knob stem; the fixing means fixing the alignment means relative to the face of the appliance.

9. A high temperature control knob comprising an alignment means, a rear plate, and a dial; the alignment means further comprising a disc portion and a raised portion; the dial of the high temperature control knob mounted on a control knob stem; the control knob stem located on a face of an appliance; the control knob stem having a longitudinal axis; said control knob stem rotating around the longitudinal axis of the control knob stem; said control knob stem extending from the face of the appliance; an arm of the dial movable to at least a predetermined maximum temperature; said alignment means having at least a one stop; at least the one stop aligned with at least the predetermined maximum temperature; the rear plate disposed between the face of the appliance and the alignment means; the face of the appliance having original temperature markings; and the rear plate configured to mask the original temperature markings; said alignment means attached to the face of the appliance; at least the one stop preventing the arm of the dial from turning past the predetermined maximum temperature.

10. The high temperature control knob of claim 9, wherein the raised portion is disposed circumferentially on said disc portion; the raised portion having at least the one stop; and at least a first slot disposed on an inner face of said disc portion allowing for said disc portion to be rotated about said control knob stem so that at least the one stop is aligned with the predetermined maximum temperature; and said alignment means fixed using a fixing means.

11. A high temperature control knob of claim 10 wherein the dial is mounted using an adapter on the control knob stem;

a first end of the adapter inserted in a depression in the dial; and the control knob stem inserted in a second end of the adapter.

12. The high temperature control knob of claim 9 wherein the predetermined maximum temperature is about an arc; and at least the one stop is aligned with the predetermined maximum temperature.

13. The high temperature control knob of claim 9 further wherein:

the dial is attached to the control knob stem and the arm moving along an arc by rotating the control knob stem; and wherein at least the one stop of the alignment means is along the arc and aligned with the predetermined maximum temperature.

14. The high temperature control knob of claim 13 wherein the alignment means further comprises a fixing means; the fixing means fixing at least the one stop.

15. The high temperature control knob of claim 14 wherein the alignment means comprises a disc portion and a raised portion; at least a first slot being located on the disc portion; the fixing means passing through at least the first slot in the alignment means and fixing the alignment means with at least the one stop relative to the face of the appliance.

16. The high temperature control knob of claim 15 wherein at least the first slot is located and sized for the fixing means; the first slot disposed to allow the fixing means to move along the first slot as the alignment means turns about the control knob stem; the fixing means passing through the first slot.

17. The high temperature control knob of claim 16 wherein the rear plate has a set of temperature markings and at least a first rear slot; the rear plate is attached to the appliance around the control knob stem of the control knob stem; the first rear slot aligned with the first slot; the first slot aligned with at least a first threaded aperture around the control knob stem; the fixing means disposed through the first slot and the first rear slot into the first threaded aperture.

* * * * *